US008888020B2

(12) United States Patent
Huang

(10) Patent No.: US 8,888,020 B2
(45) Date of Patent: Nov. 18, 2014

(54) MULTI-STAGE SHOWERHEAD FOR PREVENTING MIXED-FLOW AND BACK-PRESSURE

(76) Inventor: So Mei Huang, Tai Ping (TW)

( * ) Notice: Subject to any disclaimer, the term of this patent is extended or adjusted under 35 U.S.C. 154(b) by 435 days.

(21) Appl. No.: 13/425,516

(22) Filed: Mar. 21, 2012

(65) Prior Publication Data

US 2013/0248621 A1 Sep. 26, 2013

(51) Int. Cl.

| | |
|---|---|
| ***E03C 1/08*** | (2006.01) |
| ***B05B 3/04*** | (2006.01) |
| ***B05B 3/16*** | (2006.01) |
| ***A62C 31/02*** | (2006.01) |
| ***A62C 31/00*** | (2006.01) |

(52) U.S. Cl.

USPC ..... 239/428.5; 239/381; 239/390; 239/391; 239/392; 239/394; 239/446; 239/447; 239/448; 239/449

(58) Field of Classification Search

USPC ..... 239/428.5, 381, 390–392, 394, 239/445–449

See application file for complete search history.

(56) References Cited

U.S. PATENT DOCUMENTS

| | | | | |
|---|---|---|---|---|
| 4,588,130 | A * | 5/1986 | Trenary et al. | 239/381 |
| 5,022,429 | A * | 6/1991 | Rollini et al. | 137/218 |
| 5,862,985 | A * | 1/1999 | Neibrook et al. | 239/99 |
| 7,740,186 | B2 * | 6/2010 | Macan et al. | 239/11 |
| 8,020,788 | B2 * | 9/2011 | Luettgen et al. | 239/463 |
| 2013/0015268 | A1 * | 1/2013 | Huang | 239/428.5 |

* cited by examiner

*Primary Examiner* — Len Tran
*Assistant Examiner* — Alexander M Valvis
(74) *Attorney, Agent, or Firm* — Rosenberg, Klein & Lee

(57) ABSTRACT

A multi-stage showerhead for preventing mixed flow and back pressure, in which a capacity space is set inside a housing, the capacity space is provided for placing an inner disk, an outer disk, a distribution base, an outlet base, a bottom base and a water-gas mixing seat, wherein at least a counter-stop pad is set inside the water-gas mixing seat for avoiding that water and gas fixed to produce back-pressure counter current, to thereby ensure the purpose of water-saving and not reducing the strength of water.

4 Claims, 7 Drawing Sheets

MULTI-STAGE SHOWERHEAD FOR PREVENTING MIXED-FLOW AND BACK-PRESSURE

BACKGROUND OF THE INVENTION

1. Field of the Invention

The invention relates to a multi-stage showerhead for preventing mixed flow and back pressure and, more particularly, to a multi-stage showerhead which avoid that water and gas fixed to produce back-pressure counter current, to thereby ensure the purpose of water-saving and not reducing the strength of water.

2. Description of Related Art

Since modern people are particular about various washing fun during showering, multi-stage showerhead is developed. The structure of a conventional multi-stage showerhead A (as shown in FIG. 1) mostly has various operational designs of watering, such as general showering mode, sparkling mode, massage mode and mixed mode. However, in the past, under the condition of supplying water with large flow amount, no matter what water-supplying mode is used, the problem of supplying water-reducing may not be worried due to the water pressure is enough. With the popular concepts in water conservation, governments develop a variety of water-saving practices for reducing water usage. Therefore, the supplying water of the multi-stage showerhead changed from high flow to low flow. Under this kind of use standard, due to the diversion effect, the back-pressure phenomenon often occurs when mixing water and the strength of water may be reduced. Users have complained widely, but it is regrettable that so far the industry does not have a better solution to improve the shortcomings.

SUMMARY OF THE INVENTION

In view of the problem that the conventional showerhead cannot solve the problem of the reduced strength of water caused by the back pressure, the inventor refers to his prior art patent (U.S. application Ser. No. 13/137,008, TW Appl. No. 100211840), which is a pressurized structure mixing air and water flow. The inventor completes to develop the present invention after numerous improvements, namely, the object of the invention is to provide a multi-stage showerhead which avoid that water and gas fixed to produce back-pressure counter current, to thereby ensure the purpose of water-saving and not reducing the strength of water.

To achieve the object, in the present invention, a capacity space is set inside a housing, the capacity space is provided for placing an inner disk, an outer disk, a distribution base, an outlet base, a bottom base and a water-gas mixing seat, wherein at least a counter-stop pad is set inside the water-gas mixing seat for avoiding that water and gas fixed to produce back-pressure counter current, to thereby ensure the purpose of water-saving and not reducing the strength of water.

The feature of the abovementioned invention is that a positioning hole and at least an outlet hole are set on the bottom of the mixing chamber of the water-gas mixing seat, the positioning hole is provided for locating a location column of a counter-stop pad, a sheet body extended outward from the top of the counter-stop pad is covered on the outlet hole, the counter-stop pad with the non-reversing function is used to prevent the back-pressure counter current flowing into air channel.

BRIEF DESCRIPTION OF THE INVENTION

The detail structure, the applied principle, the function and the effectiveness of the present invention can be more fully understood with reference to the following description and accompanying drawings, in which.

DETAILED DESCRIPTION OF THE PREFERRED EMBODIMENTS

Figure 1:
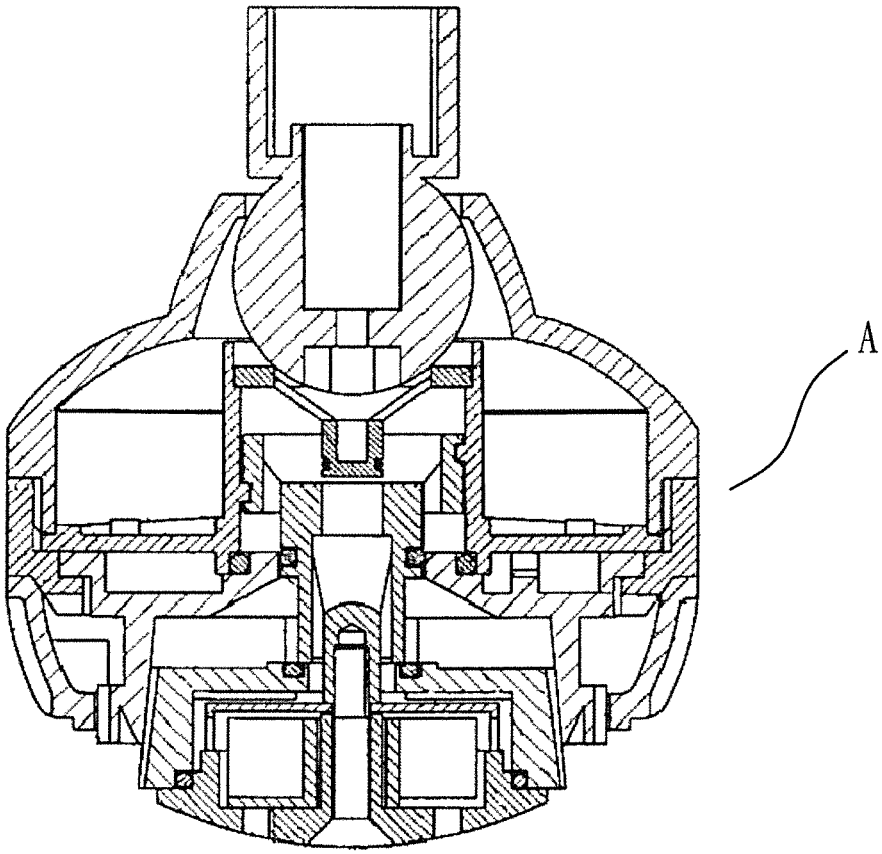
FIG. 1 PRIOR ART
FIG. 1 is a schematic diagram of a conventional showerhead structure.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

Figure 2:
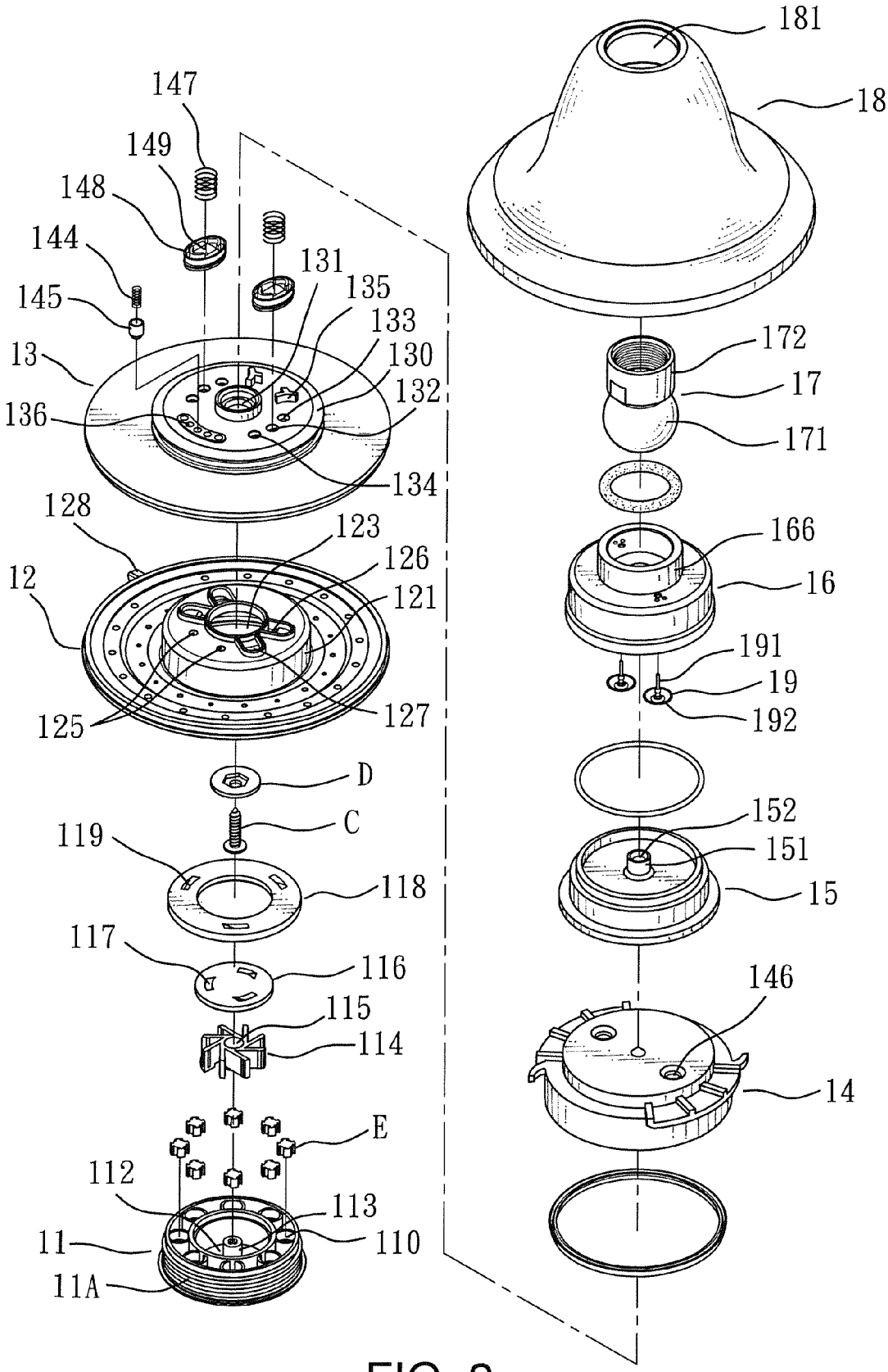
FIG. 2 is a three-dimensional exploded diagram according to the present invention.
Figure 3:
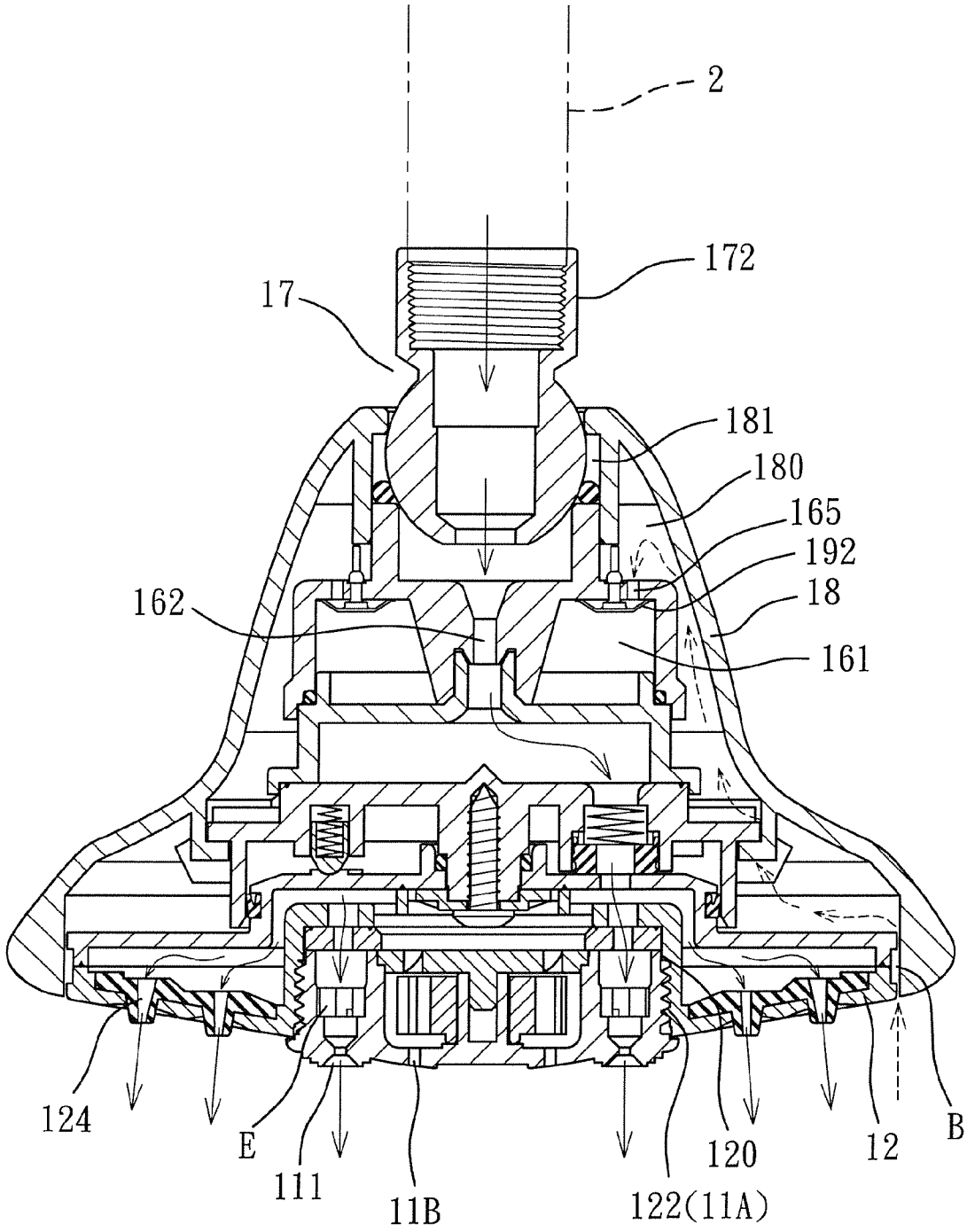
FIG. 3 is a schematic diagram of shower and bubbling water according to the present invention.
Figure 4:
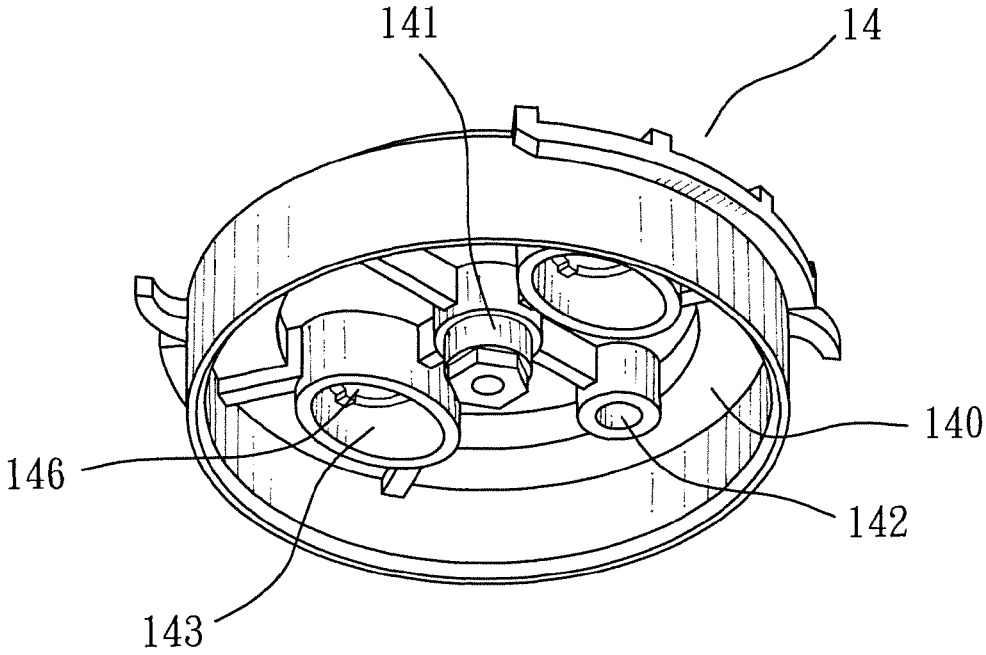
FIG. 4 is a three-dimensional exploded diagram of the outlet base according to the present invention.
Figure 5:
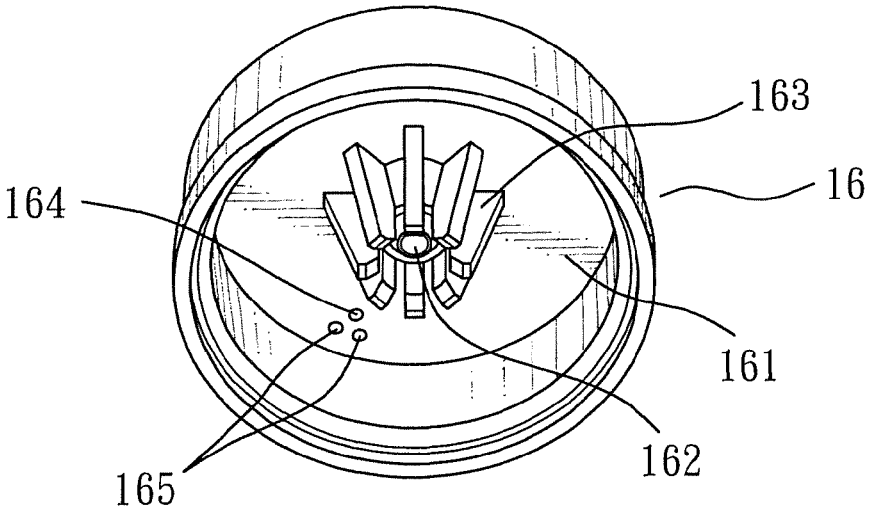
FIG. 5 is a three-dimensional exploded diagram of the water-gas mixing seat according to the present invention.
Figure 6:
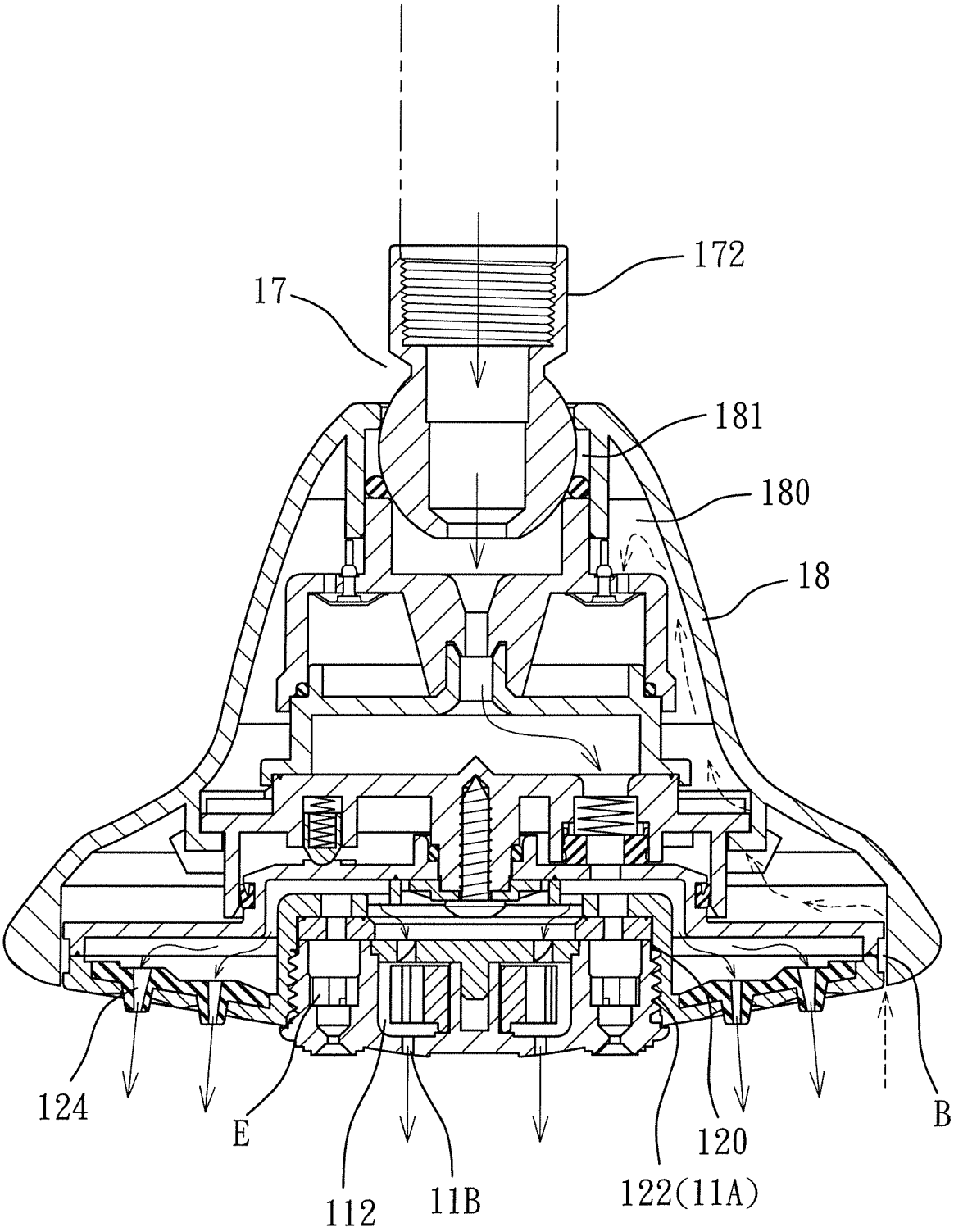
FIG. 6 is a schematic diagram of shower and massage water according to the present invention.

Please refer to FIG. 2, FIG. 3 and FIG. 6, the multi-stage showerhead of the present invention, in which a capacity space 180 is set inside a housing 18, the capacity space 180 is provided for placing an inner disk 11, an outer disk 12, a distribution base 13, an outlet base 14, a bottom base 15 and a water-gas mixing seat 16, wherein:

the inner disk 11, in which an impeller chamber 112 is set in the inner side concavely, a hole column 113 is set in the center of the impeller chamber 112, multiple massage water holes 11B are set on the bottom of the impeller chamber 112, the hole column 113 is provided for a shaft hole 115 of an impeller 114 wrapped up, to limit the impeller 114 being placed inside the impeller chamber 112, an inner cover sheet 116 is covered on the top of the impeller chamber 112, at least a fourth water outlet hole 117 is set on the inner cover sheet 116, multiple bubbling chambers 110 are surrounded on the outside of the impeller chamber 112, multiple bubbling water holes 111 are set on the bottom of the bubbling chamber 110, a movable column E is placed inside the bubbling chamber 110, a ring gasket 118 is covered on the top of multiple bubbling chambers 110, at least a third water outlet hole 119 is set on the ring gasket 118, and an external thread part 11A is set on the circumference of the inner disk 11;

the outer disk 12, a circle cavity 120 is set in the center on the outside of the outer disk 12, multiple shower water holes 124 are set surrounded on the circumference outside of the circle cavity 120, the circle cavity 120 is expanded backwards to form a supporting seat 121, an internal thread part 122 is set on the inner circumference of the circle cavity 120 for screwing the external thread part 11A of the inner disk 11, a first aperture 123 is set in the center of the supporting seat 121, at least a fourth through hole 125, at least a fifth through hole 126 and at least a sixth through hole 127 are respectively set on the outside near the first aperture 123, and a rotating element 128 is set on the circumference of the outer disk 12 (the rotating element 128 is used to rotating the outer disk 12 conveniently, which may be a handle or a block, or a groove);

the distribution base 13, which is a plate body attached on the outer disk 12, a wrapped part 130 is convexly extended on its one side for wrapping up the supporting seat 121 of the outer disk 12, a second aperture 131 is set in the center of the wrapped part 130, and at least a first through hole 132, at least a second through hole 133, a third through hole 134, at least a limit stop 135 and a positioning hole row 136;

the outlet base 14, which has an inner cavity 140 (please refer to FIG. 4), a hole column 141 with an internal screw hole is set in the center of the inner cavity 140 for a bolt C passing through a washer D to fixedly screw the outer disk 12 and the distribution base 13 on the hole column 141, a positioning chamber 142 and at lease a shim containing chamber 143 are set inside the inner cavity 140 of the outlet base 14, the positioning chamber 142 is provided for containing a second spring 144 and a location column 145, to let the location column 145 touched the positioning hole row 136, a second water outlet hole 146 is set on the bottom of the shim containing chamber 143, a first spring 147 and a spacing shim 148 are contained inside the shim containing chamber 143, the spacing shim 148 has a through hole 149, the spacing shim 148 is touched and corresponded to the location of the first through hole 132, the second through hole 133 and the third through hole 134 of the distribution base 13;

the bottom base 15, which is fixed on one side of the outlet base 14, a hole column 151 having a through hole 152 is set in the center of the bottom;

the water-gas mixing seat 16, in which a mixing chamber 161 concavely set on the front side is attached on the bottom side of the bottom base 15, a first water outlet hole 162 is set in the center of the mixing chamber 161, multiple ribs 163 are set on the circumference of the first water outlet hole 162, a sleeve joint part 166 is extended backwards from the back side of the water-gas mixing seat 16 for sleeve joining the ball head 171 of a sphere connector 17;

the housing 18, which has a capacity space 180, a through hole 181 is set on the bottom of the capacity space 180 for a junction part 172 of the sphere connector 17 passing through to set up with a water pipe 2;

the feature is:

a positioning hole 164 and at least a outlet hole 165 are set on the bottom of the mixing chamber 161 of the water-gas mixing seat 16 (please refer to FIG. 5), the positioning hole 164 is provided for locating a location column 191 of a counter-stop pad 19, a sheet body 192 extended outward from the top of the counter-stop pad 19 is covered on the outlet hole 165, the counter-stop pad 19 with the non-reversing function is used to prevent the back-pressure counter current flowing into air channel.

Figure 7:
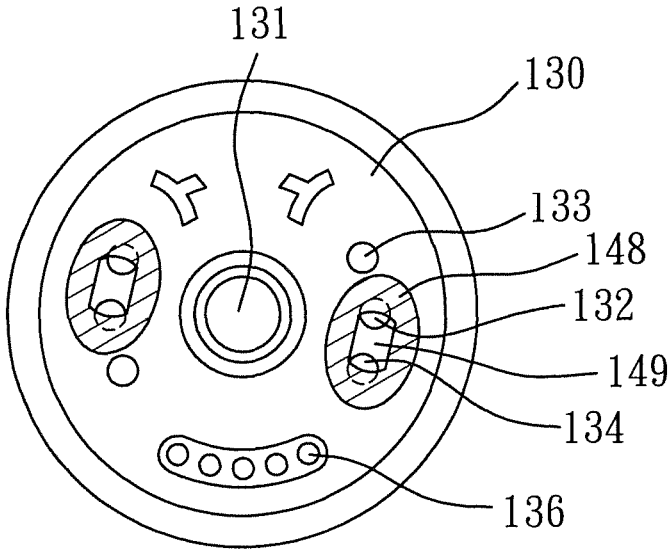
FIG. 7 is a schematic diagram (1) of the action of the distribution base and the spacing shim according to the present invention.
Figure 9:
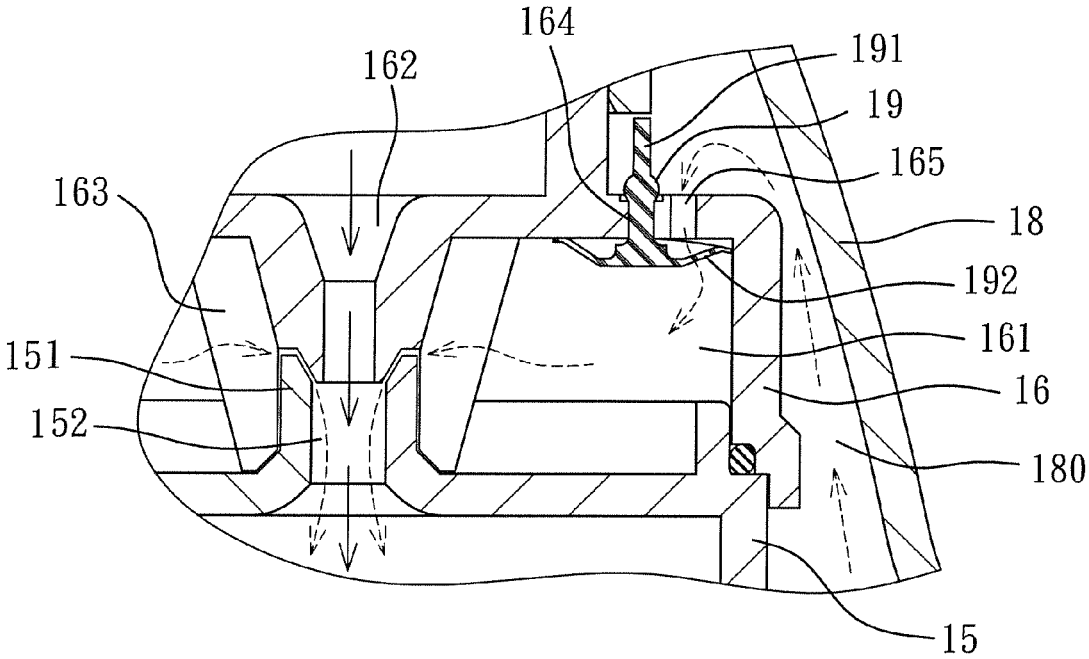
FIG. 9 is a schematic diagram (1) of the action of the counter-stop pad according to the present invention.
Figure 10:
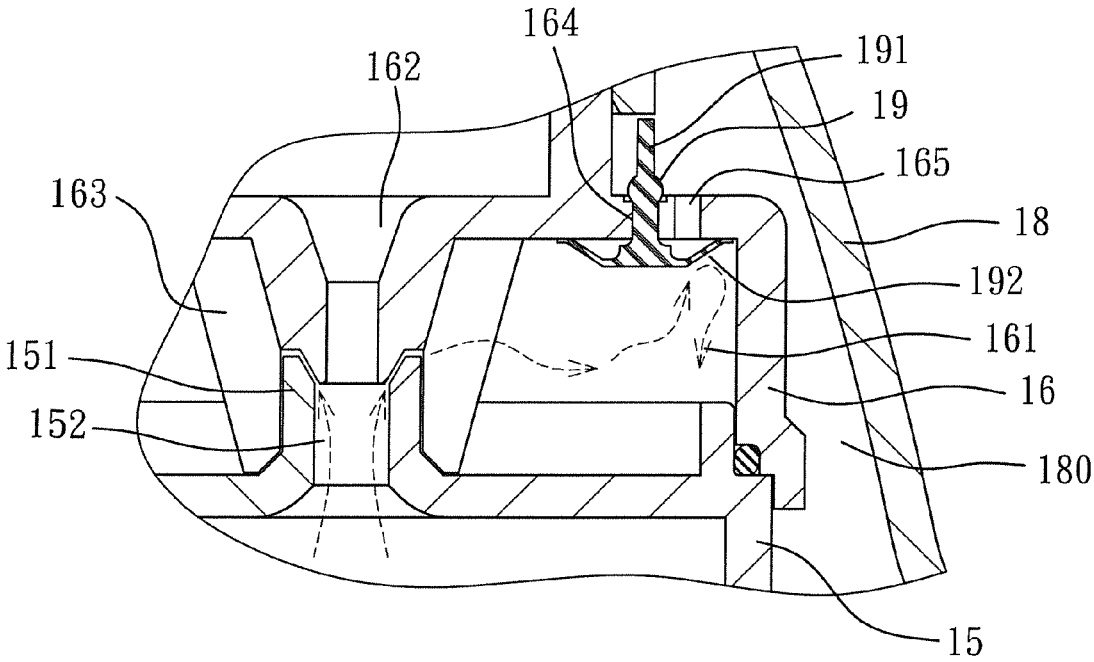
FIG. 10 is a schematic diagram (2) of the action of the counter-stop pad according to the present invention.

By the composition of the above structure, when a user rotates the rotating element 128 by fingers to turn the outer disk 12 into the shower/bubbling mixing water position (as shown in FIG. 3 and FIG. 7). At this time, water enters along the water pipe 2, and enters the mixing chamber 161 through the first water outlet hole 162. The water flow simultaneously draws air inflowing from the gap between the capacity space 180 of the housing 18 and the outer disk 12. Air arrives the outlet hole 165 along the remaining space between the capacity space 180 and its internal components, pushes the sheet body 192 of the counter-stop pad 19, and enters the mixing chamber 161 to mix with water flow (as shown in FIG. 9), to thereby form the mixed-flow of gas and water. The mixed flow flows along the first through hole 132 and the third through hole 134 (as shown in FIG. 3 and FIG. 7), and outflows from the shower water hole 124 and the bubbling water hole 111 to achieve the mixed-flow operation of shower water and bubbling water simultaneously. At this time, although the water flow may create back pressure due to the distribution effect, the counter-stop pad 19 has the non-reversing function (as shown in FIG. 10) and the back-pressure counter current may not be occurred to enter the air channel, to strengthen the force of water, to thereby improve the drawback of reducing the strength of water and back-pressure counter current of mixed flow of the conventional showerhead.

Figure 8:
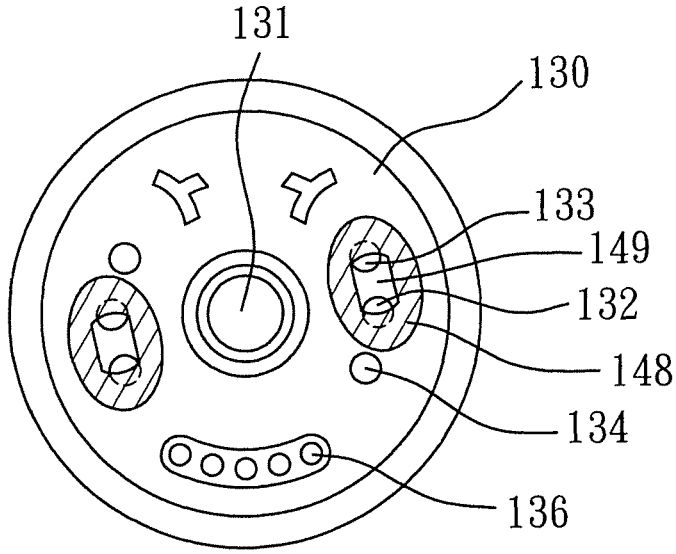
FIG. 8 is a schematic diagram (2) of the action of the distribution base and the spacing shim according to the present invention.

Similarly, in the mixed-flow operation of shower water and massage water (please refer to FIG. 6 and FIG. 8), the rotating element 128 is rotated by fingers to turn the outer disk 12 into the shower/massage mixing water position. After mixing in the mixing chamber 161, the mixed flow outflows from the shower water hole 124 and the massage water hole 11B along the first through hole 132 and the second through hole 133, to achieve the mixed-flow operation of shower water and massage water simultaneously. The counter-stop pad 19 performs the same non-reversing function (as shown in FIG. 9), air is drawn by water flow and enters the mixing chamber 161 continuously to mix air and water to thereby strengthen the impact force of the mixed flow. Also, due to the non-reversing function of the counter-stop pad 19 (as shown in FIG. 10), the back-pressure counter current is effectively prevented from entering into air channel. Thus, air may not be stopped due to the back pressure, and the purpose of not reducing the strength of water may be effectively achieved.

I claim:

1. A multi-stage showerhead for preventing mixed flow and back pressure, in which a capacity space is set inside a housing, the capacity space is provided for placing an inner disk, an outer disk, a distribution base, an outlet base, a bottom base and a water-gas mixing seat comprising:

the inner disk, in which an impeller chamber is set in the inner side concavely, a hole column is set in the center of the impeller chamber, multiple massage water holes are set on the bottom of the impeller chamber, the hole column is provided for a shaft hole of an impeller wrapped up, to limit the impeller being placed inside the impeller chamber, an inner cover sheet is covered on the top of the impeller chamber, at least a fourth water outlet hole is set on the inner cover sheet, multiple bubbling chambers are surrounded on the outside of the impeller chamber, multiple bubbling water holes are set on the bottom of the bubbling chamber, a movable column is placed inside the bubbling chamber, a ring gasket is covered on the top of multiple bubbling chambers, at least a third water outlet hole is set on the ring gasket, and an external thread part is set on the circumference of the inner disk;

the outer disk, a circle cavity is set in the center on the outside of the outer disk, multiple shower water holes are set surrounded on the circumference outside of the circle cavity, the circle cavity is expanded backwards to form a supporting seat, an internal thread part is set on the inner circumference of the circle cavity for screwing the external thread part of the inner disk, a first aperture is set in the center of the supporting seat, at least a fourth through hole, at least a fifth through hole and at least a sixth through hole are respectively set on the outside near the first aperture, and a rotating element is set on the circumference of the outer disk;

the distribution base, which is a plate body attached on the outer disk, a wrapped part is convexly extended on its one side for wrapping up the supporting seat of the outer disk, a second aperture is set in the center of the wrapped part, and at least a first through hole, at least a second through hole, a third through hole, at least a limit stop and a positioning hole row;

the outlet base, which has an inner cavity, a hole column with an internal screw hole is set in the center of the inner cavity for a bolt passing through a washer to fixedly screw the outer disk and the distribution base on the hole column, a positioning chamber and at lease a shim containing chamber are set inside the inner cavity of the outlet base, the positioning chamber is provided for containing a second spring and a location column, to let the location column touched the positioning hole row, a second water outlet hole is set on the bottom of the shim containing chamber, a first spring and a spacing shim are contained inside the shim containing chamber, the spacing shim has a through hole, the spacing shim is touched and corresponded to the location of the first through hole, the second through hole and the third through hole of the distribution base;

the bottom base, which is fixed on one side of the outlet base, a hole column having a through hole is set in the center of the bottom;

the water-gas mixing seat, in which a mixing chamber concavely set on the front side is attached on the bottom side of the bottom base, a first water outlet hole is set in the center of the mixing chamber, multiple ribs are set on the circumference of the first water outlet hole, a sleeve joint part is extended backwards from the back side of the water-gas mixing seat for sleeve jointing a ball head of a sphere connector;

the housing, which includes the capacity space, a through hole is set on the bottom of the capacity space for a junction part of the sphere connector passing through to set up with a water pipe; and wherein a positioning hole and at least a outlet hole are set on the bottom of the mixing chamber of the water-gas mixing seat, the positioning hole is provided for locating a location column of a counter-stop pad, a sheet body extended outward from the top of the counter-stop pad is covered on the outlet hole, the counter-stop pad with the non-reversing function is used to prevent the back-pressure counter current flowing into an air channel.

2. The multi-stage showerhead for preventing mixed flow and back pressure as claimed in claim 1, wherein the rotating element is a handle set on the circumference of the outer disk.

3. The multi-stage showerhead for preventing mixed flow and back pressure as claimed in claim 1, wherein the rotating element is a block set on the circumference of the outer disk.

4. The multi-stage showerhead for preventing mixed flow and back pressure as claimed in claim 1, wherein the rotating element is a groove set on the circumference of the outer disk.

* * * * *